United States Patent [19]

Johnson

[11] Patent Number: 4,802,340

[45] Date of Patent: Feb. 7, 1989

[54] REFRIGERATED SALAD BAR

[75] Inventor: Thomas M. Johnson, Troy, Ohio

[73] Assignee: Hobart Corporation, Troy, Ohio

[21] Appl. No.: 113,704

[22] Filed: Oct. 28, 1987

[51] Int. Cl.[4] ..... F25B 49/00; A47F 3/04

[52] U.S. Cl. ..... 62/229; 62/255; 62/258

[58] Field of Search ..... 62/252, 255, 258, 261, 62/420, 229

[56] References Cited

U.S. PATENT DOCUMENTS

| | | | |
|---|---|---|---|
| 2,438,355 | 3/1948 | Wilson | 62/258 X |
| 2,463,658 | 3/1949 | Thrasher | 62/258 X |
| 2,476,491 | 7/1949 | Henderson | 62/255 X |
| 2,669,851 | 2/1954 | Pickler | 62/258 X |
| 2,786,337 | 3/1957 | Spring | 62/258 |
| 2,886,395 | 5/1959 | Cahn | 62/258 X |
| 3,866,435 | 2/1975 | Frank et al. | 62/420 X |
| 4,019,339 | 4/1977 | Anderson | 62/255 |
| 4,457,140 | 7/1984 | Rastelli | 62/261 |

*Primary Examiner*—William E. Tapolcai

*Attorney, Agent, or Firm*—Russell L. McIlwain

[57] ABSTRACT

A refrigerated appliance for use as a salad bar includes an enclosure having a refrigeration unit mounted therein and a cooled food storage compartment. An upper wall of the storage compartment is provided with openings for receiving a plurality of foodstuff containers having bottom wall surfaces which extend into the compartment. An air inlet opening from the refrigeration unit is disposed proximate to the upper wall of the compartment and cool air issuing therefrom is directed at the exposed wall surfaces of the containers. To concentrate the air flow at the containers a duct surrounds the air inlet opening and is spaced closely from the containers. A free end of the duct is open to the storage compartment for circulation of the air through the compartment. Proper sizing of the duct permits the air within the duct to be maintained at a temperature lower than the temperature of the compartment, whereupon perishable refill foodstuffs for the containers may be stored within the compartment while the containers may be chilled to much the same degree as in a conventional ice-type salad bar unit.

8 Claims, 3 Drawing Sheets

REFRIGERATED SALAD BAR

BACKGROUND OF THE INVENTION

1. Field of the Invention

The present invention relates generally to refrigerated appliances for cooling foodstuffs or the like, and it relates more particularly to a novel appliance having the ability to serve as a salad bar without requiring the use of ice for maintaining salad foodstuffs in a chilled state during serving.

2. Description of the Prior Art

A conventional salad bar of the type found in restaurants and cafeterias, in one form, includes a cabinet having a counter top provided with a central opening. The opening is fitted with one or more relatively shallow pans which are suitable for holding a quantity of crushed ice. Food containers of various sizes may be placed in the ice such that the contents of the containers are maintained at a relatively low temperature, thereby preserving the contents of the containers against premature spoilage.

While salad bars of the foregoing description have long been in widespread use, they are not without a number of disadvantages. First, the use of ice in quantities sufficient to fill this type of salad bar is inconvenient for the proprietor of the food service operation. Often the ice must be supplied from off the premises and must be loaded into the salad bar manually at intervals frequent enough to ensure that the food containers are adequately chilled. In addition, as the ice melts, water within the salad bar pan must be manually drained and transported usually to a remote location or directed to an open floor drain for disposal. Thus, the maintenance of an ice-type salad bar is a time consuming task.

Since an ice-type salad bar must be designed to display numerous food containers filled with vegetables, condiments and the like, the supporting cabinet unit is often large in size and occupies considerable floor space. While the cabinet may be designed for storage purposes, such storage space cannot be used for any food items requiring refrigeration because the ice is capable only of chilling items placed in relatively close heat transferring relationship to it. Accordingly, the available storage space of the ice-type salad bar unit cannot be used to store additional quantities of most of the foodstuffs usually displayed on the top of the salad bar.

In another form, a salad bar is known which has a refrigeration unit and a cooling coil positioned against a plate located beneath the vegetable filled containers. However, the coil is capable of freezing and damaging the contents of the containers because of difficulties in maintaining a suitably controlled heat transfer relationship between the containers and the refrigerated plate. In addition, while some of these salad bars have storage compartments disposed beneath the refrigeration coil, cool air circulation within the compartment is not provided for and, therefore, foodstuffs stored within the compartment are not chilled with uniform reliability.

SUMMARY OF THE INVENTION

It is therefore an object of the present invention to provide a new and improved salad bar which overcomes the disadvantages associated with ice chilled and coil chilled salad bars of the conventional type. In accordance with the invention, there is provided an enclosure having an insulated storage compartment and refrigeration unit. A top wall of the enclosure is provided with a plurality of openings communicating with the storage compartment. The openings are adapted to receive foodstuff containers having heat transferring bottom wall surfaces extending into the compartment. A cool air inlet to the compartment is provided from the refrigeration unit. The inlet is disposed in proximity to the top wall of the enclosure and is adapted to direct cool air across the bottom wall surfaces of the containers. To concentrate the cool air on the containers a duct is provided for receiving the air from the inlet, at one end, and allowing the air to issue into the compartment, at a second end, whereupon the air returns to the refrigeration unit through an outlet disposed opposite of the end wall of the compartment away from the second end of the duct.

Ideally, the salad bar of the present invention is constructed with a duct having dimensions such that a typical refrigeration unit can maintain the air in the vicinity of the foodstuff containers at a uniform temperature of 34° F. to 35° F. while the storage compartment is maintained at about 37° F. To uniformly cool the foodstuff containers, a baffle may be provided at the cool air inlet to divert air from becoming excessively concentrated on certain of the containers. A single thermostat and refrigeration unit may thereby be used to maintain the containers and storage compartment at differential temperatures.

A salad bar so constructed offers the advantages of being maintainable with little manual effort while affording opportunity for better temperature control of foodstuffs displayed on top of the salad bar and stored in the compartment below.

BRIEF DESCRIPTION OF THE DRAWING

The present invention will be better understood from the following description of a preferred embodiment thereof taken in connection with the accompanying drawing in which.

DETAILED DESCRIPTION OF THE PREFERRED EMBODIMENT

Figure 1:
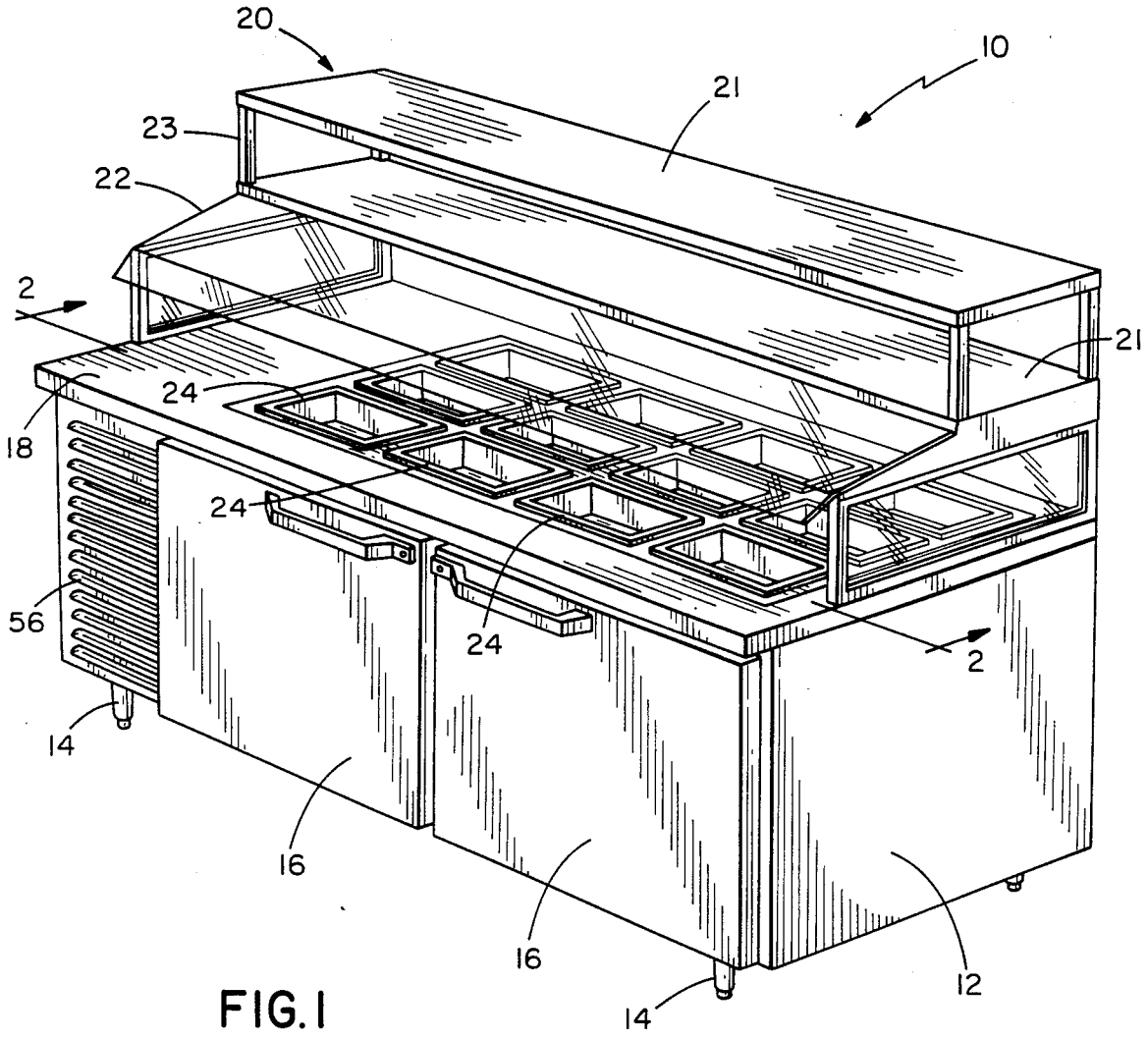
FIG. 1 is a front perspective view of a salad bar constructed in accordance with the principles of the present invention.

Referring now to the drawings, and initially to FIG. 1 thereof, there is illustrated a salad bar, designated generally by the reference numeral 10. The salad bar 10 includes a rigid enclosure 12 supported by a plurality of suitable legs 14. The front face of the enclosure 12 is, in one configuration, provided with a pair of hinged doors 16, permitting access to the interior thereof, and with an upper counter top 18. A superstructure 20 is fixed to the counter top 18 and comprises a pair of shelves 21 together with a transparent hood 22 and supporting frame 23, the hood 22 serving to protect the contents of the salad bar 10 against contamination. A plurality of foodstuff containers 24 are positioned within openings provided in the counter top 18.

Figure 2:
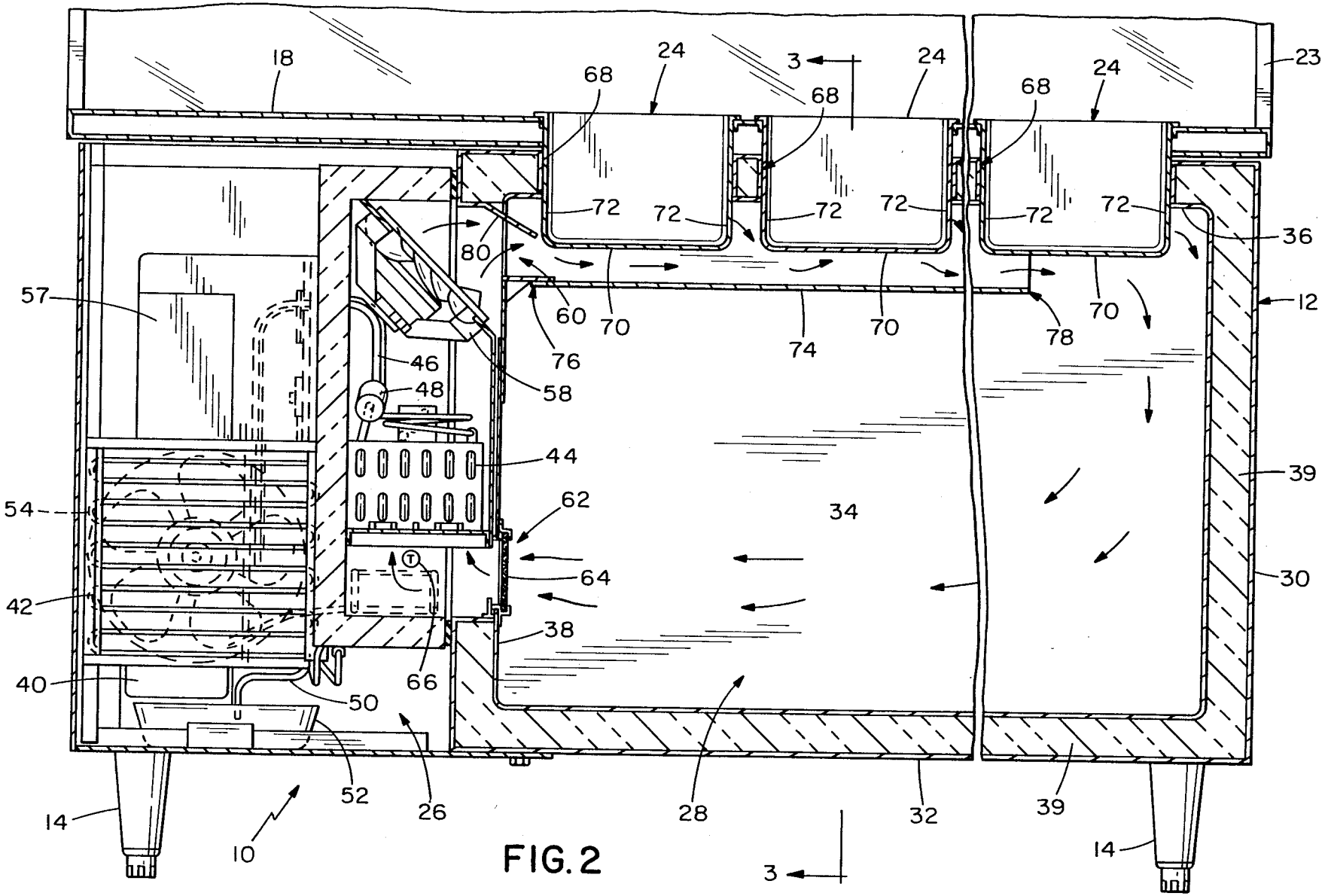
FIG. 2 is an enlarged fractional cross-sectional view taken substantially along the lines 2—2 of FIG. 1.
Figure 3:
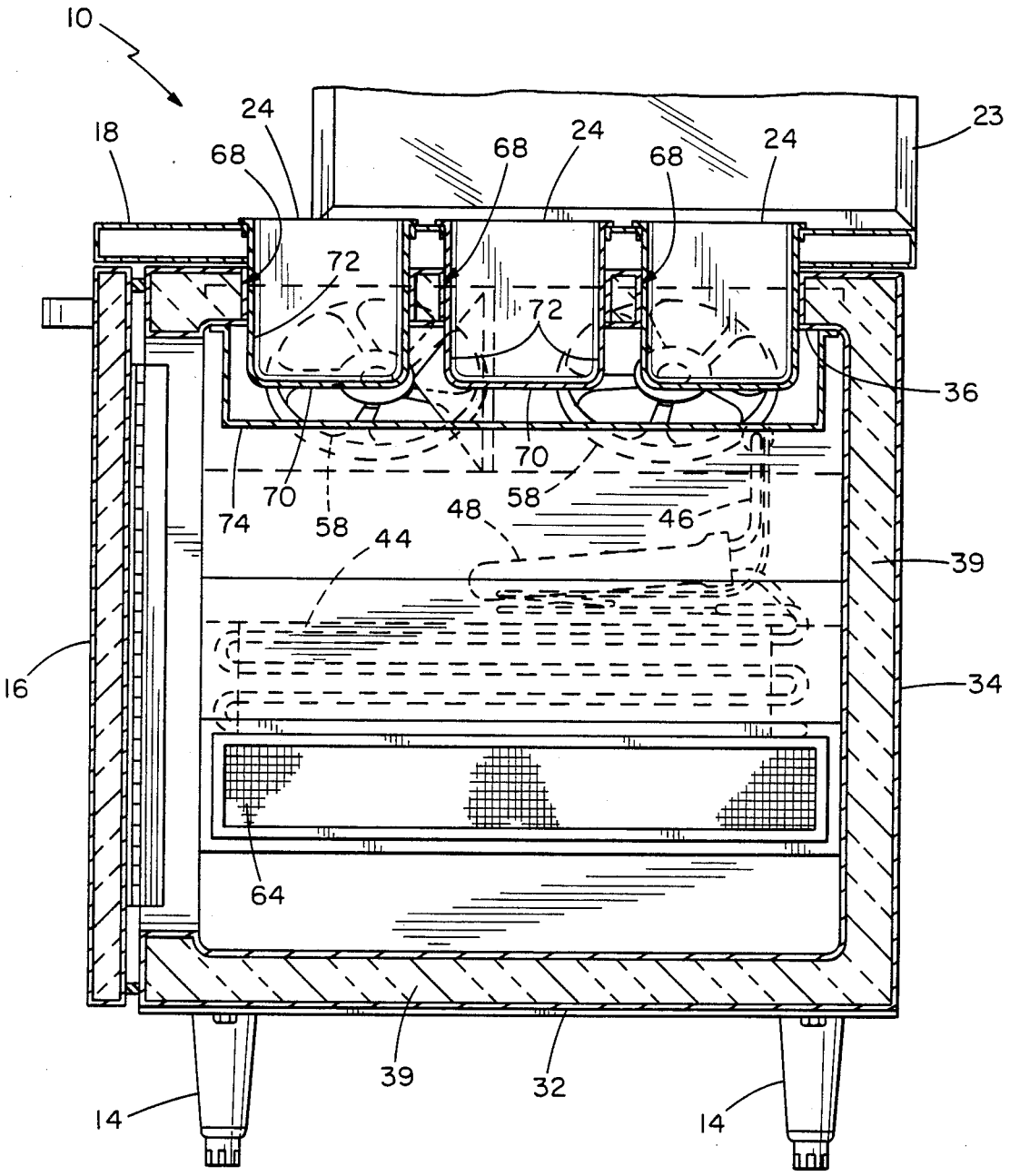
FIG. 3 is a cross-sectional view taken substantially along the lines 3—3 of FIG. 2.

Turning now to FIGS. 2 and 3, the interior of the salad bar 10 may be seen to include a refrigeration unit, designated generally by the reference numeral 26, and a food storage compartment 28. The food storage compartment 28 is formed in a manner well known in the art by an end wall 30, a bottom wall 32, a rear wall 34, a top wall 36 and an interior side wall 38, all of which are constructed of suitable double wall fabricated sheet metal members with a layer of insulation material 39 disposed therebetween.

In order to provide for an overall compact and efficient salad bar structure, the refrigeration unit 26 is mounted within the enclosure 12 beneath the counter top 18 and to one side of the food storage compartment 28. The illustrated refrigeration unit 26 components are typical of the components commonly used in refrigerators of conventional type and include a compressor 40, a condenser assembly 42 and an evaporator assembly 44. Compressor suction line 46 may preferably be provided with an accumulator 48 for separating liquid and vapor stage refrigerant. A condensate drain line 50 discharges to a suitable dish 52 wherein the condensate may evaporate. A fan 54 is provided to cool the condensor 42 and, as best shown in FIG. 1, air circulating through the fan 54 vents through a series of louvres 56 provided in the front of the enclosure 12. A time clock control 57 is provided for purposes of defrosting the evaporator 44, as needed. A pair of cool air circulating fans 58 draw air over the evaporator 44 and circulate it through the food storage compartment 28 by way of an air inlet opening 60 and a return air opening 62, the latter being fitted with a suitable grill 64. To control the temperature of the air within the salad bar 10, a thermostat 66 is positioned adjacent the evaporator 44 for sensing the temperature of the air leaving the storage compartment 28 and providing a control signal to the compressor 40.

An important feature of the present invention resides in the construction of the food storage compartment 28 and the manner in which cool air is circulated therethrough. Specifically, the top wall 36 of the compartment 28 is formed with openings 68 extending therethrough underlying the openings of the counter top 18. The openings 68 are sized to receive the foodstuff containers 24 such that bottom walls 70 and side walls portions 72 of the containers 24 extend into the storage compartment 28. In addition, as best seen in FIG. 2, the air inlet opening 60 from the refrigeration unit 26 is disposed in close proximity to the top wall 36 of the storage compartment 28. Accordingly, cool air issues from the inlet opening 60 and is immediately directed against the undersurfaces 70 and 72 of the foodstuff containers 24. To further concentrate cool air on the containers 24, in accordance with the invention a duct 74 is suspended from the top wall 36 of compartment 28 and has a first end 76 connected to interior side wall 38 surrounding the air inlet opening 60. A second end 78 of he duct 74 is open to the storage compartment 28 allowing for circulation of cool air into the compartment 28 and out through the return air opening 62. Preferably the second end 78 of the duct 74 is terminated in close proximity to end wall 30 of the food storage compartment 28 in order to ensure that all containers 24 are uniformly chilled.

Since the salad bar 10 is constructed with a plurality of foodstuff containers 24 arranged in rows running lengthwise of the counter top 18, some containers 24 are disposed in close proximity to the air inlet opening 60 and would have a tendency to be chilled to a greater degree than those disposed more remote from the opening 60. Accordingly, to eliminate differential cooling of the containers 24 a baffle 80 is provided extending downwardly from the top wall 36 of the storage compartment 28 immediately in front of the opening 60. The baffle 80 serves effectively to deflect air toward the duct 74, thereby diverting the air from being concentrated on the containers 24 positioned nearest the opening 60. In preferred form the duct 74 is disposed within a few inches from the bottom walls 70 of the foodstuff containers 24 and thereby cooled air is concentrated uniformly o the containers 24 before it circulates through the food storage compartment 28 prior to exiting through the return air opening 62.

It can be appreciated that a salad bar 10 constructed in accordance with the invention offers significant advantages over prior ice-type and coil chilled units. The use of a refrigeration unit 26 to chill the foodstuff containers 24 permits virtually a maintenance free operation. Moreover, the duct 74 construction is such as to allow for differential cooling of the containers and storage compartment without the need for specially adapted controls or dual refrigeration units. Preferably the duct 74 and refrigeration unit 26 are sized such that with the evaporator refrigerant maintained at 25° F., the air within the duct 74 will be maintained at between 34° F. to 35° F., while the air within the food storage compartment 28 will be maintained at approximately 37° F. By such an arrangement, the foodstuff within the containers 24 can effectively be maintained at a temperature equal to or below 45° F. when the salad bar 10 is in use in typical ambient temperature conditions. It is desirable to limit the temperature of the foodstuff to 45° F. to retard bacterial growth which is ordinarily accelerated above such a temperature level. Advantageously, the use of a refrigeration unit 26 adapted to supply cool air to the storage compartment 28 permits the enclosure 12 of the salad bar 10 to be used for storage of perishables, offering the opportunity for effective temperature control whereby refill foodstuffs for the containers 24 may be conveniently and safely stored. In the latter regard, the construction of the duct 74 having its open end 78 located across the storage compartment 28 from the return air opening 62 provides for uniform temperature within the food storage compartment 28 and for even chilling of the foodstuffs stored therewithin. In addition, the duct 74 serves to prevent food droppings from entering the storage compartment 28 from above, and may be readily cleaned by simply removing the foodstuff containers 24 from the salad bar 10. Although the salad bar 10 has been illustrated with only one configuration of containers 24, virtually any number of containers may be used, and the salad bar 10 may be designed with any convenient or preferred width and length to meet the particular needs of the food service operation in which it is to be used.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed as new and desired to be secured under Letters Patent of the United States is:

1. A refrigerated appliance for cooling foodstuffs or the like comprising an enclosure having a refrigeration unit mounted therein and an insulated storage compartment for storing foodstuffs, the improvement comprising;

said enclosure having a top wall provided with one or more openings therein communicating with said compartment, said openings adapted for receiving foodstuff containers having heat transferring bottom wall surfaces, a cool air inlet from said refrigeration unit for providing cool air to said storage compartment, said inlet being disposed in proximity to said top wall of said enclosure and adapted to direct cool air across the bottom wall surfaces of said containers, a duct having one end configured to receive cool air issuing from said inlet and having a second end open to said compartment, said compartment having a return air opening providing for the return to the refrigeration unit of air issuing from said second end of said duct, said duct disposed in closely spaced relation to the bottom wall surfaces of said foodstuff containers, and a baffle within said duct for diverting cool air away from one of said foodstuff containers disposed proximate to said cool air inlet, wherein said cool air is concentrated in said duct for maintaining the air within the duct at a temperature below the temperature of the compartment.

2. An appliance according to claim 1 wherein the air temperature within said duct is maintained at a temperature of between 34° F. and 35° F.

3. An appliance according to claim 2 wherein said storage compartment is maintained at a temperature of approximately 37° F.

4. An appliance according to claim 2 wherein the foodstuff within said containers is maintained at a temperature of less than or equal to 45° F.

5. An appliance according to claim 3 including a single thermostat for controlling and maintaining the aforesaid air temperature within both said duct and said compartment.

6. An appliance according to claim 1 wherein said compartment comprises an end wall disposed across said compartment from said cool air inlet and said second open end of the duct is spaced from said end wall to provide for circulation of cool air from said inlet to said return air opening.

7. An appliance according to claim 6 wherein said return air inlet is disposed across said compartment from said second open end of said duct.

8. An appliance according to claim 1 wherein said duct serves as a shield between said openings and said compartment thereby preventing foodstuffs from dropping into said compartment.

* * * * *